US006491050B2

(12) United States Patent
Whiddon

(10) Patent No.: US 6,491,050 B2
(45) Date of Patent: Dec. 10, 2002

(54) LEG SUPPORT FOR CRUTCH

(76) Inventor: Joe L. Whiddon, 62230 Powell Butte Rd., Bend, OR (US) 97411

( * ) Notice: Subject to any disclaimer, the term of this patent is extended or adjusted under 35 U.S.C. 154(b) by 0 days.

(21) Appl. No.: 09/782,891

(22) Filed: Feb. 12, 2001

(65) Prior Publication Data

US 2001/0032661 A1 Oct. 25, 2001

Related U.S. Application Data

(60) Provisional application No. 60/182,046, filed on Feb. 11, 2000.

(51) Int. Cl.[7] ..... A61H 3/02

(52) U.S. Cl. ..... 135/66; 135/68; 135/73; 135/76

(58) Field of Search ..... 135/65–68, 73, 135/76

(56) References Cited

U.S. PATENT DOCUMENTS

| | | | | |
|---|---|---|---|---|
| 751,942 A | | 2/1904 | Renno | |
| 1,463,675 A | | 7/1923 | Coleman | |
| 2,378,486 A | | 6/1945 | Jones | |
| 2,495,889 A | | 1/1950 | Connaghan | |
| 2,678,054 A | | 5/1954 | Bostelman | |
| 4,058,119 A | | 11/1977 | Rosequist | |
| 4,141,375 A | * | 2/1979 | Tykwinski | 135/66 |
| 4,291,715 A | * | 9/1981 | Monte | 135/68 |
| 4,793,370 A | | 12/1988 | Perez et al. | |
| 4,910,927 A | | 3/1990 | Beatty | |
| 4,924,894 A | * | 5/1990 | Martinez | 135/65 |
| 5,090,434 A | | 2/1992 | Hagen | |
| 5,291,909 A | | 3/1994 | Skorman et al. | |
| 5,300,016 A | | 4/1994 | Marlatt | |
| 5,746,236 A | | 5/1998 | Tilsley et al. | |
| 5,941,263 A | | 8/1999 | Bierman | |
| 5,983,912 A | * | 11/1999 | Leu | 135/66 |

FOREIGN PATENT DOCUMENTS

| | | | | |
|---|---|---|---|---|
| WO | WO9810676 | * | 3/1998 | 135/68 |

* cited by examiner

*Primary Examiner*—Beth A. Stephan
(74) *Attorney, Agent, or Firm*—Glenn C. Brown; Glenn C. Brown, P.C.

(57) ABSTRACT

A leg support for attachment to a crutch for supporting the affected leg of a user, and having a cushioned upper surface. The support is preferably adjustable to a variety of heights on the crutch, and adjustable to position the cushioned upper member at one or more preselected angles for enhanced comfort.

12 Claims, 3 Drawing Sheets

LEG SUPPORT FOR CRUTCH

This invention relates to crutches, and in particular to a leg support that can be mounted on the crutch to support a user's leg. This patent application claims priority from U.S. Provisional Application Serial No. 60/182,046, filed Feb. 11, 2000.

Crutches have taken many forms over the years, and all have been designed to permit a user to ambulate while protecting a leg, that is to be able to ambulate without the need to place all or part of the user's body weight on the user's leg(s). Even so, known crutches have not addressed the needs of many users to be able to rest the affected leg by supporting it while standing for long periods of time.

This invention addresses this long felt and unmet need by providing a leg support that can be readily attached to a conventional crutch, and which provides a support whereon the user can rest the affected leg. The invention will now be described in detail with reference to the drawings.

DETAILED DESCRIPTION

Figure 1:
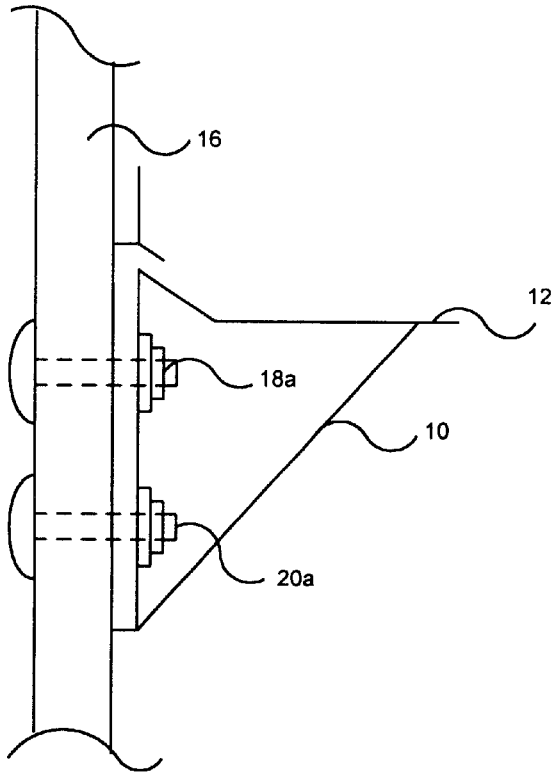
FIG. 1 is a front view of a preferred embodiment of a leg support according to the present invention
Figure 2:
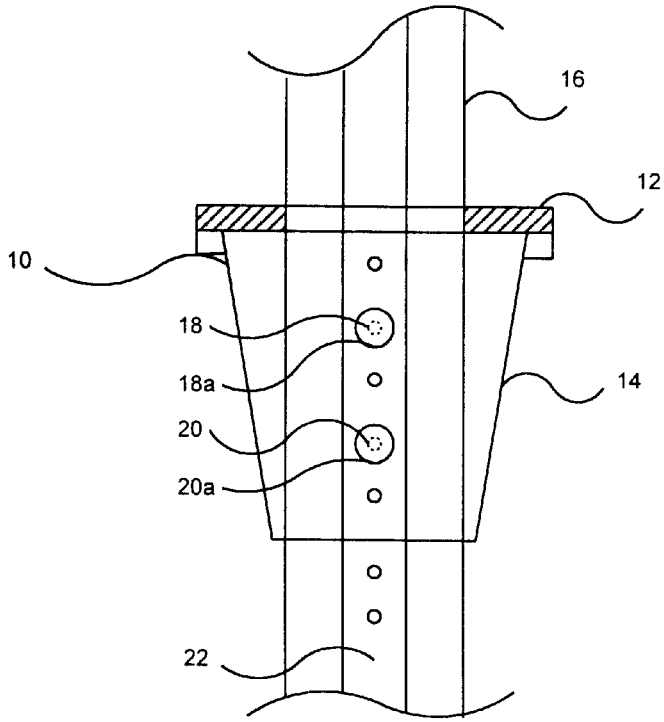
FIG. 2 is a right side view of the embodiment shown in FIG. 1.
Figure 3:
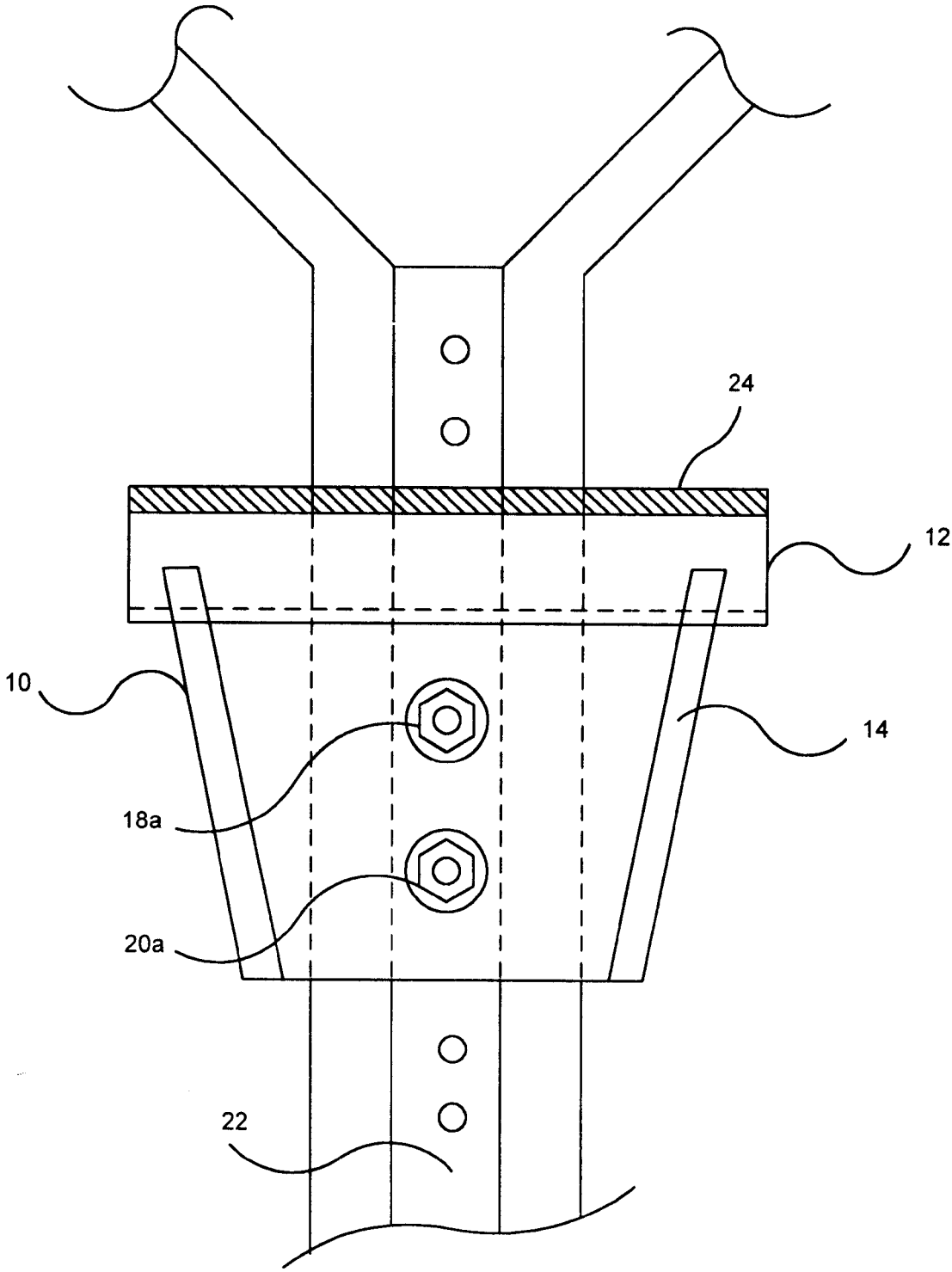
FIG. 3 is a left side view of the embodiment shown in FIG. 1.
Figure 4:
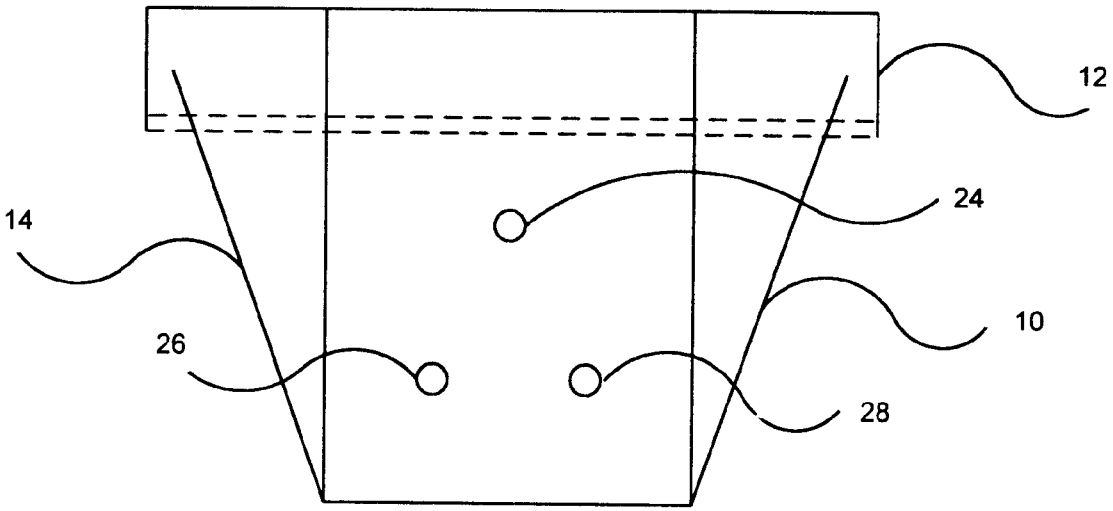
FIG 4 is a top view of a second embodiment differing from that of FIG. 1 in that the support can be angled for enhanced comfort.

Turning now to FIGS. 1–4, a leg support according to the present invention is shown generally at 10. Leg support 10 includes a lateral member 12 and a angled support 14. Leg support 10 is shaped to closely engage the lower portion of a crutch 16, to which it is attached by two bolts 18*a* and 20*a* in the preferred embodiment. In this embodiment, the holes 18 and 20 are spaced apart a distance corresponding to the spacing of predrilled holes in the lower member 22 of the crutch. The spacing is typically 1 inch, which permits the leg support to be fittable to most commercially manufactured crutches. In an alternative embodiment shown in FIG. 4, three holes 24, 26 and 28 are provided. Holes 26 and 28 are positioned so that when either is engaged, along with the upper hole 24, the lateral member 12 is angled downwardly toward the front or back to enhance the comfort of the support to the user. In a preferred embodiment shown in FIG. 3, the lateral member 12 includes a padded or cushioned upper surface 24.

The leg support of the present invention is of particular benefit in several situations. First, in the case of an amputee the end of the user's leg can rest directly on the leg support, thereby transferring part of the user's weight from the arms back to the leg. In the case of an injury to the lower leg, the knee can rest on the knee support to transfer part of the user's body weight to the leg, again relieving the user's arms of part of the user's body weight. In this instance, the additional benefit is that the user can rest the weight of the leg on the support rather than having to continually support the injured leg to raise it off of the ground. Another benefit of the leg support of the present invention is that it converts the crutch into a leg support that can be used while the user is sitting as well as standing.

The leg support of the present invention can be used by most anyone requiring crutches as a result of its adjustability along the length of the lower member of the crutch, and a single design is interchangeable for use with either a right or left side crutch.

The leg support of the present invention can be manufactured in any suitable conventional manner, i.e. by casting, fabrication, or molding. In addition, it can also be attached to a walker in addition to its utility with crutches.

I claim:

1. A leg support comprising:

a lateral member for supporting a user's leg, the lateral member having a cushioned upper surface;

a vertical member connected to the lateral member for engaging a crutch frame, the vertical member having at least two holes spaced apart a preselected distance, the preselected distance corresponding to the distance between predrilled holes in a crutch; and, the at least two holes in the vertical member including a first hole vertically offset from a pair of laterally spaced apart lower holes, each of the lower holes spaced apart from the upper hole by said preselected distance.

2. A leg support according to claim 1 wherein the lateral spacing of the lower holes is selected to provide preselected angular displacement of the lateral member.

3. A leg support according to claim 1 wherein the lateral member is contoured to conform to a user's leg.

4. A leg support according to claim 1 that further comprises an angled support extending between the lateral member and the vertical member.

5. A leg support according to claim 1 wherein the leg support comprises a molded member.

6. A leg support according to claim 1 wherein the lateral member cushioned upper surface comprises a removable pad.

7. A crutch comprising:

a vertical member having an upper portion for engaging the under arm of a user, a handle for gripping, and a leg support, the leg support comprising:

a lateral member for supporting a user's leg, the lateral member having a cushioned upper surface;

a vertical member connected to the lateral member for engaging the crutch frame, the vertical member having at least two holes spaced apart a preselected distance, the preselected distance corresponding to the distance between predrilled holes in the crutch; and, the at least two holes in the vertical member including a first hole vertically offset from a pair of laterally spaced apart lower holes, each of the lower holes spaced apart from the upper hole by said preselected distance.

8. A crutch according to claim 7 wherein the lateral member is contoured to conform to a user's leg.

9. A crutch according to claim 7 wherein the lateral member is contoured to conform to a user's leg.

10. A crutch according to claim 7 that further comprises an angled support extending between the lateral member and the vertical member.

11. A crutch according to claim 7 wherein the leg support comprises a molded member.

12. A crutch according to claim 7 wherein the lateral member cushioned upper surface comprises a removable pad.

* * * * *